US011745235B2

(12) United States Patent
Gohr et al.

(10) Patent No.: US 11,745,235 B2
(45) Date of Patent: Sep. 5, 2023

(54) METHOD AND DEVICE FOR CONTROLLING A STRETCH REDUCING ROLLING MILL FOR WALL THICKNESS COMPENSATION

(71) Applicant: SMS group GmbH, Düsseldorf (DE)

(72) Inventors: Alexander Gohr, Mönchengladbach (DE); Peter Thieven, Aachen (DE)

(73) Assignee: SMS group GmbH, Düsseldorf (DE)

( * ) Notice: Subject to any disclaimer, the term of this patent is extended or adjusted under 35 U.S.C. 154(b) by 343 days.

(21) Appl. No.: 17/270,022

(22) PCT Filed: Aug. 15, 2019

(86) PCT No.: PCT/EP2019/071975
§ 371 (c)(1),
(2) Date: Feb. 21, 2021

(87) PCT Pub. No.: WO2020/038832
PCT Pub. Date: Feb. 27, 2020

(65) Prior Publication Data

US 2021/0323039 A1 Oct. 21, 2021

(30) Foreign Application Priority Data

Aug. 20, 2018 (DE) ..... 10 2018 214 002.2

(51) Int. Cl.
*B21B 37/16* (2006.01)
*B21B 17/14* (2006.01)
(Continued)

(52) U.S. Cl.
CPC ..... *B21B 37/16* (2013.01); *B21B 17/14* (2013.01)

(58) Field of Classification Search
CPC ..... B21B 37/16; B21B 37/14; B21B 37/04; B21B 37/165; B21B 37/78; B21B 37/46;
(Continued)

(56) References Cited

U.S. PATENT DOCUMENTS 3,496,745 A * 2/1970 Friedrich ..... B21B 17/14 72/12.7
4,323,971 A 4/1982 Moltner et al.
2006/0053855 A1 3/2006 Yamane

FOREIGN PATENT DOCUMENTS

DE 2947233 A1 5/1981
DE 102015118065 A1 4/2017
(Continued)

*Primary Examiner* — Matthew Katcoff
*Assistant Examiner* — Mohammed S. Alawadi
(74) *Attorney, Agent, or Firm* — Smartpat PLC

(57) ABSTRACT

A stretch reducing rolling mill for rolling pipes has a plurality of roll stands arranged in series in a conveying direction of a pipe. A wall thickness measuring device determines a wall thickness progression of the pipe prior to rolling. A control unit controls respective rotational speeds of the roll stands. A pipe position measuring device is arranged in front of the roll stands and continuously measures a current longitudinal coordinate of the pipe. The measured values of the longitudinal coordinate of the pipe are transmitted to the control unit. The control unit controls the rotational speeds of the roll stands based on both the determined wall thickness progression and the transmitted measured values of the current longitudinal coordinate of the pipe, in order to compensate for wall thickness variations of the pipe. A stretch reducing rolling mill is designed to carry out the method.

17 Claims, 3 Drawing Sheets

(51) Int. Cl.

| | |
|---|---|
| ***B21B 17/04*** | (2006.01) |
| ***B21B 37/78*** | (2006.01) |
| ***B21B 37/46*** | (2006.01) |
| ***B21B 38/04*** | (2006.01) |

(58) Field of Classification Search
CPC . B21B 38/04; B21B 2261/04; B21B 2275/04; G05D 5/02
See application file for complete search history.

(56) References Cited

FOREIGN PATENT DOCUMENTS

| | | | | | |
|---|---|---|---|---|---|
| EP | 1733817 | A1 * | 12/2006 | ..... | B21B 37/78 |
| EP | 1611969 | B1 | 7/2009 | | |
| JP | S5325259 | A | 3/1978 | | |

* cited by examiner

METHOD AND DEVICE FOR CONTROLLING A STRETCH REDUCING ROLLING MILL FOR WALL THICKNESS COMPENSATION

TECHNICAL FIELD

The present disclosure relates to a method for controlling a stretch reducing rolling mill. Further, the present disclosure relates to a control unit for a stretch reducing rolling mill. Furthermore, the present disclosure relates to a stretch reducing rolling mill.

BACKGROUND

In the manufacture of seamless pipes, a stretch reducing rolling mill, which has a plurality of roll stands arranged one behind the other in a conveying direction of a pipe to be rolled, is used. In order to achieve a reduction in the wall thickness of the pipe, which is inevitably accompanied by a stretching or elongation of the pipe in the axial direction, the rolling speed of the roll stands increases in the direction of feed.

Due to variations in the wall thickness of the rolled stock entering the stretch reducing rolling mill, the rolled stock leaving the stretch reducing rolling mill can also exhibit variations in wall thickness. Such variations are caused, for example, by inhomogeneous rolling conditions, such as changes in rolling temperature, uneven tool wear of aggregates upstream of the stretch reducing rolling mill, etc. For this reason, stretch reducing rolling mills can be equipped with control systems to control the wall thickness or reduce the variations in wall thickness during the rolling of the pipe.

A known technical solution to compensate for wall thickness variations is to influence the stretching of the pipe to be rolled by changing the respective rotational speeds of the roll stands in a targeted manner. If, for example, a section of the pipe entering the stretch reducing rolling mill is rolled with a wall thickness that is too great relative to a target value, a steeper rotational speed curve, that is, increasing rotational speed differences between adjacent roll stands, can be used to increase the instantaneous stretch and thus reduce the wall thickness more. If, on the other hand, a section is rolled with a wall thickness that is too thin relative to a target value, the instantaneous stretching in the stretch reducing rolling mill can be reduced by a flatter rotational speed curve. In this manner, wall thickness variations of the pipe entering the stretch reducing rolling mill are compensated, such that a homogenization of the wall thickness of the pipe leaving the stretch reducing rolling mill and an improvement of the rolling quality are achieved.

Controlling the rotational speeds of the roll stands as a function of the wall thickness of the pipe requires that information about the wall thickness of the pipe to be rolled and/or the rolled pipe is fed to a control unit for the stretch reducing rolling mill.

DE 2947233 A1 proposes a control system based on a measurement of the wall thickness of the pipe to be rolled before entering the stretch reducing rolling mill, that is, before being formed by the roll stands of the stretch reducing rolling mill, with an isotope radiation measuring device, a measurement of the speed of the pipe to be rolled before entering the stretch reducing rolling mill and a measurement of the speed of the rolled pipe after leaving the stretch reducing rolling mill. Such a control system suffers from the disadvantage that short-wave wall thickness variations with expansions below the rolling mill length cannot be compensated for.

U.S. Pat. No. 3,496,745 A proposes dispensing with a control loop and carrying out a measurement of the average wall thickness and the wall thickness progression of the pipe to be rolled, that is, only before forming by the roll stands of the stretch reducing rolling mill. To determine the wall thickness progression of the pipe to be rolled, the instantaneous wall thickness of the pipe to be rolled is measured by a wall thickness measuring device at different longitudinal positions or longitudinal coordinates of the pipe, and the measured wall thicknesses are stored in association with the longitudinal positions as a wall thickness progression. During the rolling of the pipe in the stretch reducing rolling mill, a control unit adjusts the respective rotational speeds of the roll stands of the stretch reducing rolling mill in accordance with a wall thickness control algorithm on the basis of the wall thickness progression finally determined in advance by the wall thickness measuring device, in order to compensate for wall thickness variations of the pipe to be rolled during the rolling of the pipe in the stretch reducing rolling mill. U.S. Pat. No. 3,496,745 A further proposes that the control unit starts the compensation of the wall thickness variations as a function of a signal from an optical sensor, which is arranged inside the stretch reducing rolling mill or in front of the first roll stand of the stretch reducing rolling mill and provided for detecting the front end of the pipe in the conveying direction.

Typically, the determination of the wall thickness progression within the meaning of U.S. Pat. No. 3,496,745 A is not carried out immediately before the pipe to be rolled enters the roll stands of the stretch reducing rolling mill, but, in terms of the process, well before the stretch reducing rolling mill, for example before the pipe to be rolled is heated in a reheating furnace upstream of the stretch reducing rolling mill. The pipe wall thickness does not change during transport.

The optical sensor provided to detect the front end of the pipe is exposed to steam, dust and splashing water, which can lead to inaccurate or erroneous detection results. If the front end of the pipe is detected even slightly too late on the basis of contamination of the optical sensor, the control unit starts the control for wall thickness compensation with a delay. In such a case, the rotational speed changes of the roll stands initiated by the control unit lag behind the actual position of the pipe in the stretch reducing rolling mill in terms of time, such that the wall thickness of the rolled pipe can exhibit arbitrary, unpredictable variations.

An additional disadvantage of the prior art is the fact that the transport or conveying speed of the pipe into the stretch reducing rolling mill is not necessarily constant, but can change during rolling. Thus, from the mere sensor signal for the front end of the pipe and a theoretical conveying speed, it is not possible to precisely determine which section of the pipe is currently in the stretch reducing rolling mill.

SUMMARY

Therefore, the present disclosure is based on the task of providing a method and a control unit for controlling a stretch reducing rolling mill, along with a stretch reducing rolling mill itself for rolling pipes, which ensure reliable compensation of wall thickness variations of the pipe to be rolled and wall thicknesses of the rolled pipe within a narrow tolerance range.

The task is achieved by a method presented below. The task is also achieved by a control unit as disclosed. In addition, the task is achieved by a stretch reducing rolling mill as described.

In order to achieve the object of the present disclosure, during the transport of the pipe to be rolled to the roll stands of the stretch reducing rolling mill, the instantaneous position of the pipe to be rolled relative to the first roll stand of the stretch reducing rolling mill is continuously measured by a pipe position measuring device arranged in front of the roll stands in the conveying direction of the pipe. The measured values of the pipe position measuring device are continuously transmitted to the control unit for the stretch reducing rolling mill. The control unit controls the respective rotational speeds of the roll stands not only on the basis of the wall thickness progression of the pipe to be rolled as determined by a wall thickness measuring device, but also on the basis of the continuously transmitted measured values of the pipe position measuring device, in order to compensate for wall thickness variations of the pipe to be rolled in the stretch reducing rolling mill.

More specifically, in accordance with the method presented, the pipe position measuring device continuously measures a current longitudinal coordinate of the pipe at a section of the pipe that is not instantaneously being rolled by the stretch reducing rolling mill. During the measurements of the current longitudinal coordinate of the pipe to be rolled, which are continuously carried out by the pipe position measuring device, the pipe is moved relative to the pipe position measuring device in the conveying direction to the stretch reducing rolling mill. The conveying direction corresponds to the longitudinal direction of the pipe or the direction of the longitudinal coordinate of the pipe, as the case may be. During this relative movement of the pipe, the pipe position measuring device is designed to record a position of the front end of the pipe in the conveying direction, also called the pipe tip, and a position of the rear end of the pipe, also called the pipe end, and to assign corresponding measured longitudinal coordinates to such positions. The longitudinal coordinate of the pipe measured at a point in time represents the length of a section of the pipe to be rolled, which has already passed through the longitudinal coordinate measurement carried out by the pipe position measuring device. In accordance with the method presented, a length measurement is thus performed by the pipe position measuring device, which currently and with high temporal resolution measures which longitudinal section or which pipe length, as the case may be, has already passed the pipe position measuring device. The pipe position measuring device continuously transmits the measured values determined by it to the control unit or makes the measured values available to an interface device designed for transmission to the control unit.

The pipe position measuring device can determine the longitudinal coordinate of the pipe by means of continuous measuring methods known per se, such as an optical, electromagnetic and/or imaging measuring method of the pipe length. Whether the pipe position measuring device measures the longitudinal coordinate directly or measures it indirectly by a mathematical transformation, for example a single or multiple integration, of a primary measured variable is irrelevant to the present invention.

From the measured values of the longitudinal coordinate of the pipe continuously transmitted by the pipe position measuring device, the control unit calculates the longitudinal position of the pipe currently entering the stretch reducing rolling mill, that is, instantaneously coming into contact with the forming rolls of the first roll stand on the entry side. For this calculation, the control unit uses the distance known to it between the pipe position measuring device and the first roll stand of the stretch reducing rolling mill on the entry side. From the measured longitudinal coordinates of the two ends of the pipe to be rolled, the control unit can also calculate the total length of the pipe to be rolled.

From the wall thickness progression of the pipe to be rolled, which is known to the control unit and was previously determined by the wall thickness measuring device, the control unit determines the instantaneous or current wall thickness, as the case may be, of the pipe at the longitudinal position of the pipe that is currently entering the stretch reducing rolling mill. If such instantaneous wall thickness exceeds/falls below a predetermined target wall thickness, the control unit, in accordance with a known rolling model, changes the rotational speeds of the roll stands within the meaning of the steeper/flatter rotational speed curves explained above.

Taking into account the known distance between the pipe position measuring device and the first roll stand of the stretch reducing rolling mill on the entry side, the distances between the roll stands of the stretch reducing rolling mill using mathematical approaches for modelling the filling behavior within the contact zones between the pipe and the rolls of the roll stands, the control unit uses the current longitudinal position of the pipe determined as described above, in order to determine the instantaneous material distribution of the pipe on the entry side, within the stretch reducing rolling mill and, if appropriate, also on the exit side of the stretch reducing rolling mill. Specifically, the portion of the pipe that is inside the stretch reducing rolling mill is determined.

The term "continuous measurement of the longitudinal coordinate of the pipe" is understood to mean that, during the relative movement between the pipe position measuring device and the pipe passing it, a measurement is undertaken several times by the pipe position measuring device, in order to measure how long the section of the pipe, which has already passed the pipe position measuring device, is at the moment. Such measurements can be made continuously in time or discretely in time at defined points in time. On the other hand, the term "continuous measurement of the longitudinal coordinate of the pipe" does not mean that only the pipe tip to be rolled is detected and the detection is reported to the control unit.

Since, with the proposed method, the current position of the pipe before and in the stretch reducing rolling mill is determined with high accuracy and fed separately to the control unit in addition to the determined wall thickness progression, the control unit can precisely control the respective rotational speeds of the roll stands, in order to compensate for wall thickness variations of the pipe entering the stretch reducing rolling mill, such that the rolled pipe has only very small wall thickness variations within a narrow tolerance range.

In correspondence to the method presented, there is also presented a stretch reducing rolling mill for rolling pipes, with which the same advantages as with the method presented can be realized. The stretch reducing rolling mill has a plurality of roll stands arranged one behind the other in a conveying direction of a pipe to be rolled. In addition, the stretch reducing rolling mill is coupled or provided with a wall thickness measuring device arranged in front of the roll stands in the conveying direction for determining a wall thickness progression of the pipe to be rolled and with a control unit for controlling respective rotational speeds of the roll stands during the rolling of the pipe on the basis of the determined wall thickness progression, in order to compensate for wall thickness variations of the pipe. Furthermore, the stretch reducing rolling mill is coupled or provided with a pipe position measuring device arranged in front of the roll stands in the conveying direction for continuously measuring a current longitudinal coordinate of the pipe and for transmitting the measured values of the current longitudinal coordinate of the pipe to the control unit. In addition, the control unit is designed to control the rotational speeds of the roll stands during the rolling of the pipe also on the basis of the received measured values of the current longitudinal coordinate of the pipe, in order to compensate for wall thickness variations of the pipe.

Moreover, a control unit for the stretch reducing rolling mill presented above is presented. The control unit is designed to control the respective rotational speeds of the roll stands on the basis of a wall thickness progression of the pipe to be rolled, which is determined by a wall thickness measuring device prior to rolling, in order to compensate for wall thickness variations of the pipe. The control unit is further designed to receive measured values of a current longitudinal coordinate of the pipe continuously measured by a pipe position measuring device arranged in front of the roll stands in the conveying direction. In addition, the control unit is designed to control the rotational speeds of the roll stands during the rolling of the pipe also on the basis of the received measured values of the current longitudinal coordinate of the pipe, in order to compensate for wall thickness variations of the pipe.

Features of the presented method can be applied to the presented devices, that is, the control unit and the stretch reducing rolling mill, and vice versa. In addition, the disclosure allows any combination of the advanced embodiments and further embodiments presented herein.

In a further embodiment of the method presented, it is provided that the control unit controls a rolling, specifically the respective rotational speeds of the roll stands, of a first section of the pipe on the basis of measured values of the longitudinal coordinate of the pipe, while the pipe position measuring device continuously measures the current longitudinal coordinate of the pipe at a second section of the pipe.

Corresponding to this further embodiment of the method is a further embodiment of the presented stretch reducing rolling mill, with which a conveying path of the pipe to be rolled from the pipe position measuring device to a first roll stand of the stretch reducing rolling mill in the conveying direction is shorter than a total length of the pipe to be rolled. In an advanced embodiment of this further embodiment, the conveying path is shorter than half the total length of the pipe to be rolled. In an advanced embodiment of this further embodiment, the conveying path is shorter than a quarter of the total length of the pipe to be rolled.

By simultaneously measuring the longitudinal coordinate of the pipe at a rear section of the pipe and controlling the rotational speeds of the roll stands on the basis of the already existing measured values of the longitudinal coordinate during the rolling of a front section of the pipe, the control unit has a particularly precise knowledge of the current position of the pipe and can therefore adjust the rotational speeds of the roll stands particularly precisely to the current wall thickness, which is known to the control unit from the determined wall thickness progression, at the current position. Therefore, a particularly high compensation of the wall thickness variations of the entering pipe is achieved. The accuracy of the compensation of the wall thickness variations of the pipe to be rolled is higher, the shorter the conveying path or distance, as the case may be, between the pipe position measuring device and the first roll stand into which the pipe to be rolled enters.

In a further embodiment of the method presented, it is provided that the control unit controls a rolling, specifically the respective rotational speeds of the roll stands, of a first section of the pipe, while the wall thickness measuring device determines a wall thickness progression at a second section of the pipe.

This further embodiment of the method presented corresponds to a further embodiment of the stretch reducing rolling mill presented, with which a conveying path of the pipe to be rolled from the wall thickness measuring device to a first roll stand of the stretch reducing rolling mill in the conveying direction is shorter than a total length of the pipe to be rolled.

In an advanced embodiment of this further embodiment, the conveying path or distance, as the case may be, from the wall thickness measuring device to the first roll stand is shorter than half the total length of the pipe to be rolled. In an additional advanced embodiment of this further embodiment, this conveying path is shorter than a quarter of the total length of the pipe to be rolled.

By simultaneously determining the wall thickness progression of the pipe at a rear section of the pipe and controlling the rotational speeds of the roll stands on the basis of the already existing measured values of the longitudinal coordinate and the partially determined wall thickness progression during the rolling of a front section of the pipe, the control unit has a particularly precise knowledge of the current position of the pipe and can therefore adjust the rotational speeds of the roll stands particularly precisely to the current wall thickness, which is known to the control unit from the partially determined wall thickness progression, at the current position. Therefore, a very precise compensation of the wall thickness variations of the entering pipe is achieved. The accuracy of the compensation of the wall thickness variations of the pipe to be rolled is higher, the shorter the conveying path or distance, as the case may be, between the wall thickness measuring device and the first roll stand into which the pipe to be rolled enters.

In accordance with a further embodiment of the method presented, it is provided that the measured values of the longitudinal coordinate of the pipe measured by the pipe position measuring device are used for determining the wall thickness progression and for transmission to the control unit. The wall thicknesses measured by the wall thickness measuring device are thus linked to the values of the longitudinal coordinate of the pipe measured by the pipe position measuring device, which are also transmitted to the control unit. The wall thickness of the pipe to be rolled is preferably currently measured at the longitudinal position of the pipe to be rolled, which is currently measured by the pipe position measuring device as the current longitudinal coordinate.

Corresponding to this further embodiment of the method is a further embodiment of the stretch reducing rolling mill presented, with which the pipe position measuring device and the wall thickness measuring device are designed for the simultaneous measurement of the same pipe to be rolled. In an advanced embodiment of this further embodiment, the pipe position measuring device and the wall thickness measuring device are designed as a single integrated device, which measures the current longitudinal coordinate of the pipe to be rolled and the wall thickness present at this position or longitudinal coordinate, as the case may be, combines these measured values to form a wall thickness progression, and transmits the wall thickness progression and the measured values of the longitudinal coordinate to the control unit.

Particularly preferably, the wall thickness measuring device and the pipe position measuring device of the stretch reducing rolling mill presented are integrated in a single measuring device arranged in such a manner that a section of the pipe to be rolled is measured with respect to wall thickness and longitudinal coordinate, while an already measured section of the pipe is rolled under control of the control unit on the basis of the measured wall thicknesses and longitudinal coordinates, in order to compensate for wall thickness variations of the pipe to be rolled.

With these further embodiments, a particularly precise correlation between the measured wall thicknesses and the measured longitudinal coordinates is determined, resulting in a particularly precise compensation of wall thickness variations under the control of the control unit.

In accordance with a further embodiment of the method presented, it is provided that the pipe position measuring device measures the longitudinal coordinate of the pipe, the measured value of which is to be transmitted to the control unit, only after the wall thickness measuring device has determined the wall thickness progression over the total length of the pipe to be rolled.

Corresponding to this further embodiment of the method is a further embodiment of the stretch reducing rolling mill presented, with which a length of a conveying path of the pipe to be rolled between the wall thickness measuring device and the pipe position measuring device or the first roll stand, as the case may be, is greater than a total length of the pipe to be rolled.

These further embodiments offer the advantage that a conventional existing stretch reducing rolling mill, with which the distance between the wall thickness measuring device and the first roll stand into which the pipe to be rolled first enters is significantly greater than the total length of the pipe to be rolled, can be improved simply by inserting the pipe position measuring device described above between the wall thickness measuring device and the first roll stand at a short distance from the first roll stand.

In accordance with a further embodiment of the method presented, it is provided that the control unit controls rotational speeds of the roll stands also on the basis of signals from sensors arranged inside the stretch reducing rolling mill and/or behind the stretch reducing rolling mill in the conveying direction of the pipe, in order to compensate for wall thickness variations of the pipe during rolling. Through the additional sensors, the accuracy of the method and its reliability, in particular when short pipes are rolled, further increases. Then, specifically under certain circumstances, the main pipe has already left the pipe position measuring device, while the front pipe end has not yet left the stretch reducing rolling mill. Due to the additional sensors, the actual feed of the pipe is recorded and can be taken into account by the control system.

Corresponding to this further embodiment of the method is a further embodiment of the stretch reducing rolling mill presented, which is coupled or provided with sensors at or between the roll stands and/or in the conveying direction of the pipe behind the stretch reducing rolling mill. The sensors are preferably designed as proximity sensors, in order to record as accurately as possible the current position of the pipe in the area of the roll stands and/or after it has left the last roll stand. The control unit is then configured to control the rotational speeds of the roll stands also on the basis of the signals from the sensors, in order to compensate for wall thickness variations of the pipe during rolling.

BRIEF DESCRIPTION OF THE DRAWINGS

To illustrate the proposed method and the proposed stretch reducing rolling mill, exemplary embodiments of the present invention will now be presented with reference to the following figures.

In the figures, identical or similar components are designated with the same reference signs across figures.

DETAILED DESCRIPTION

Figure 1:
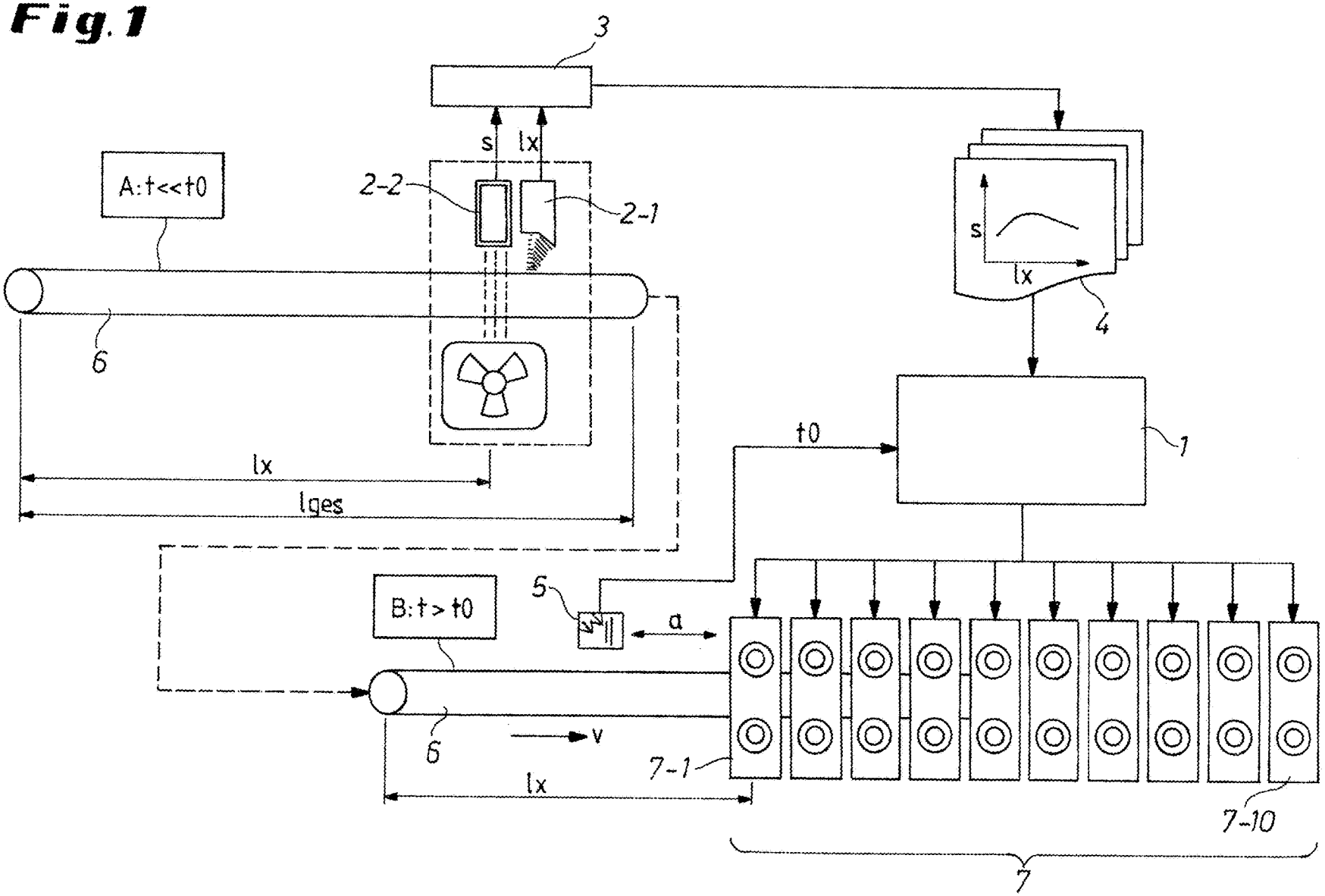
FIG. 1 schematically illustrates a stretch reducing rolling mill with a wall thickness measuring device and a proximity sensor in front of the roll stands, which represents a starting point for the exemplary embodiments shown in FIG. 2 and FIG. 3.

For better clarification of the exemplary embodiments, a stretch reducing rolling mill with a wall thickness measuring device and a proximity sensor in front of the roll stands is first presented with reference to FIG. 1. This represents the starting point for the exemplary embodiments illustrated in FIG. 2 and FIG. 3.

FIG. 1 schematically shows the pipe measuring process (see phase A) and the pipe rolling process (see phase B). In a phase A, which is clearly before the pipe to be rolled enters the roll stands, the pipe 6 to be rolled is guided in its longitudinal direction through the wall thickness measuring device 2-2, which radiometrically measures a current wall thickness s of the pipe 6 during the pipe movement and transmits it to an evaluation unit 3. Together with the measurement of the current wall thickness s, a measurement of the current longitudinal coordinate lx of the pipe 6 is performed in a pipe position measuring device 2-1 during the passage of the pipe 6 through the wall thickness measuring device 2-2. The measurement of the current longitudinal coordinate lx can be carried out optically, for example, as illustrated in FIG. 1. The evaluation unit 3 assigns the measured current wall thicknesses s and the measured current longitudinal positions lx of the pipe 6 to be rolled, at which the wall thickness measurements are carried out, to one another and thus determines a wall thickness progression 4 of the pipe 6 to be rolled. From the measured current longitudinal coordinates of the front and rear pipe ends, the evaluation unit 3 also determines the total pipe length lges of the pipe 6 to be rolled.

The determined wall thickness progression 4 and the determined total pipe length lges are transmitted by the evaluation unit to a control unit 1 for the stretch reducing rolling mill. The measurement of the current longitudinal coordinate lx of the pipe 6 explained with respect to FIG. 1 serves exclusively to determine the wall thickness progression 4, and the measured values of the current longitudinal coordinate lx are not transmitted separately to the control unit 1. The control unit 1 is designed to control the respective rotational speeds of the roll stands 7 or their work rolls, as the case may be, on the basis of the wall thickness curve 4 determined and transmitted by the evaluation unit 3. After the determination of the wall thickness progression 4, the pipe 6 to be rolled is fed to a reheating furnace (not illustrated) and then, marked in FIG. 1 as phase B for the same pipe 6, to the roll stands 7 of the stretch reducing rolling mill. To record the arrival of the pipe 6 to be rolled at the stretch reducing rolling mill, a proximity sensor 5 designed as a photocell is arranged at a distance a in front of the roll stands 7 of the stretch reducing rolling mill. The proximity sensor 5 records the arrival of the pipe tip of the pipe 6 to be rolled and reports the detection point in time t0 to the control unit 1, whereupon the control unit 1 continuously measures the time t from this point in time t0. The distance a between the proximity sensor 5 and the first roll stand 7-1 is known to the control unit 1. The approach speed v of the pipe 6 to the first roll stand 7-1 is also known to the control unit 1. The approach speed v can be a predetermined value or can be derived during operation, for example, from the rotational speeds of the roller table motors.

For controlling the rotational speeds of the roll stands 7 during the passage of the pipe through the roll stands 7, the control unit 1 requires current position information as to which location or longitudinal position, as the case may be, of the pipe to be rolled currently reaches the first roll stand 7-1. With this current position information, the control unit 1 determines from the previously determined wall thickness progression 4 of the pipe 6 to be rolled whether the location of the pipe that currently enters the first roll stand 7-1 has a wall thickness s that deviates from the nominal wall thickness, which makes it necessary to change the rotational speeds of the roll stands. The control unit 1 determines the required rotational speed changes by means of an algorithm known per se, wherein the extent of the rotational speed changes depends on the size of the wall thickness deviation. The control unit determines the current position or longitudinal coordinate lx, as the case may be, of the pipe entering the first roll stand 7-1 as:

$$lx=lges+a-v\cdot(t-t0)$$

This calculation rule provides position values for lx in the limits of $0 \leq lx \leq lges$.

With the control of the rotational speeds of the roll stands 7 illustrated in FIG. 1 for the purpose of compensating for variations in the wall thickness of the pipe to be rolled, the longitudinal coordinate lx currently entering the first roll stand 7-1 is determined indirectly, specifically by measuring the time t since the point in time t0 determined by the proximity sensor 5 and by using the approach speed v of the pipe 6.

Figure 2:
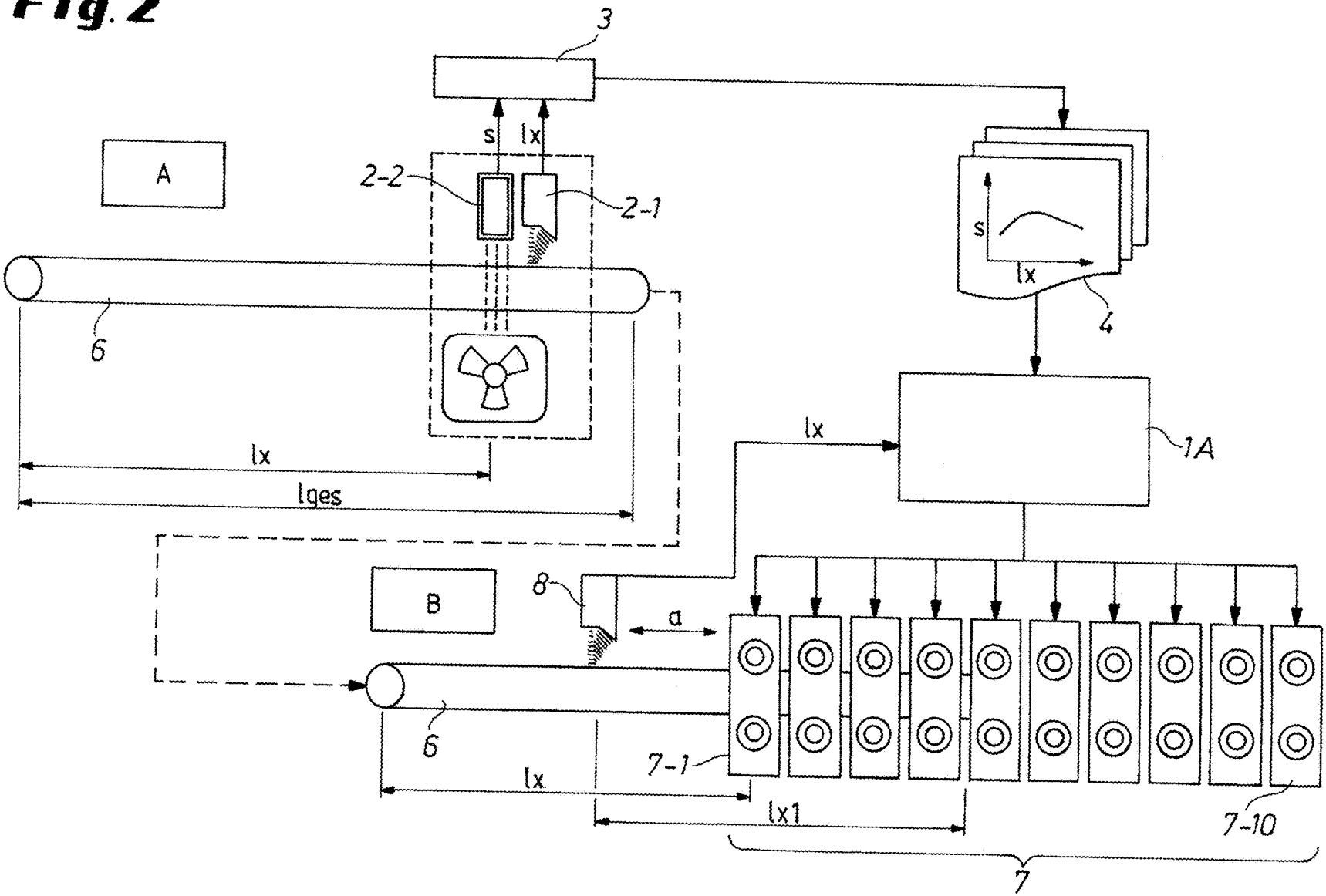
FIG. 2 schematically illustrates a stretch reducing rolling mill of an exemplary embodiment with a wall thickness measuring device and a separate pipe position measuring device in front of the roll stands.

FIG. 2 illustrates an exemplary embodiment of a proposed stretch reducing rolling mill, which results from a modification of the structure illustrated in FIG. 1. In the exemplary embodiment illustrated in FIG. 2, the wall thickness progression 4 is determined as already explained with reference to FIG. 1, such that no further explanation is required. However, instead of the proximity sensor 5 illustrated in FIG. 1 for detecting the pipe tip, in the exemplary embodiment illustrated in FIG. 2, a pipe position measuring device 8 is provided, which continuously and with high temporal resolution measures the current longitudinal coordinate lx of the pipe 6 or the pipe length lx1, as the case may be, which has already passed the pipe position measuring device 8. The pipe position measuring device 8 is arranged at a distance a in front of the first roll stand 7-1 of the stretch reducing rolling mill and continuously measures the current longitudinal coordinate lx of the pipe. The measured values of the pipe position measuring device 8 are continuously transmitted to the control unit 1A. The control unit 1A determines the current position or longitudinal coordinate, as the case may be, of the pipe 6 entering the first roll stand 7-1 as:

$$lx=lges-lx1+a$$

This immediate determination of the longitudinal position of the pipe 6 currently entering the first roll stand 7-1 offers the advantage of a higher accuracy of the determination of the position of the pipe than with the structure illustrated in FIG. 1. Since the position of the pipe entering the first roll stand 7-1 in accordance with the exemplary embodiment of FIG. 2 can be determined very precisely, the control unit 1A can determine the current wall thickness s of the pipe at this position very precisely from the determined wall thickness progression 4, and can therefore also control the rotational speeds of the roll stands 7 very precisely on the basis of the determined current wall thickness.

An essential difference between the stretch reducing rolling mills illustrated in FIG. 1 and FIG. 2 with upstream measuring devices is that, with the exemplary embodiment illustrated in FIG. 2, the measured values of the current longitudinal position of the pipe to be rolled are continuously transmitted to the control unit 1A, and the control unit 1A controls the rotational speeds of the roll stands also on the basis of these measured values, in order to compensate for wall thickness variations of the pipe to be rolled.

The exemplary embodiment in accordance with FIG. 2 also provides a particularly great ability to compensate for wall thickness variations of the pipe to be rolled, if the pipe position measuring device 8 measures the current longitudinal coordinate of a rear section of the pipe, while the control device 1A simultaneously controls the rotational speeds of the roll stands 7 during the rolling of a front section of the pipe. In such a case, the conveying path of the pipe from the pipe position measuring device 8 to the first roll stand 7-1 of the stretch reducing rolling mill is shorter than the total length lges of the pipe 6 to be rolled.

The exemplary embodiment illustrated in FIG. 2 is preferably used if a stretch reducing rolling mill with an already existing wall thickness measuring device, which measures the pipe to be rolled well before it enters the roll stands, is to be improved with regard to the precision of the compensation of wall thickness variations.

Figure 3:
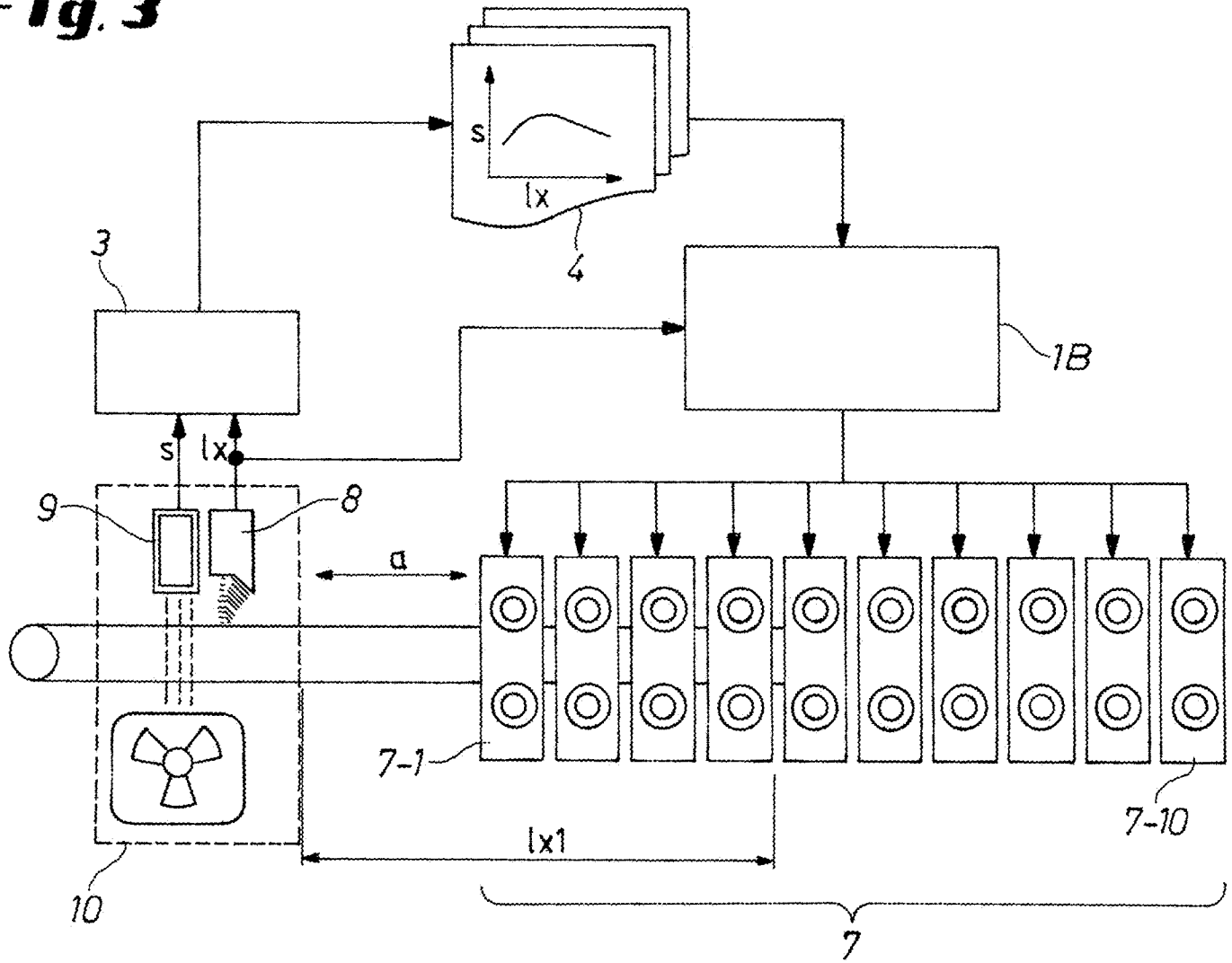
FIG. 3 schematically illustrates a stretch reducing rolling mill of an exemplary embodiment with an integrated wall thickness measuring device and pipe position measuring device in front of the roll stands.

FIG. 3 illustrates an additional exemplary embodiment of a proposed stretch reducing rolling mill, with which, unlike the exemplary embodiment of FIG. 2, a wall thickness measuring device 9 is arranged close to the first roll stand 7-1 of the stretch reducing rolling mill. The conveying path of the pipe to be rolled from the wall thickness measuring device 9 to the first roll stand 7-1 is shorter than the total length lges of the pipe 6 to be rolled. Preferably, the pipe is simultaneously in the wall thickness measuring device 9 and the roll stands 7 of the stretch reducing rolling mill for a major part of the rolling time. The pipe position measuring device 8 is preferably designed together with the wall thickness measuring device 9 as an integrated device 10, such that the pipe position measuring device 8 and the wall thickness measuring device 10 measure the pipe 6 simultaneously.

As illustrated in FIG. 3, the measured values of the pipe position measuring device 8 are duplicated and simultaneously fed to the evaluation unit 3 for determining the wall thickness progression 4 and to the control unit 1B for controlling the rotational speeds of the roll stands. While the pipe position measuring device 8 continuously measures the longitudinal coordinate lx and continuously transmits a corresponding data stream to the control unit 1B, the evaluation unit 3 continuously transmits a data stream to the control unit 1B, which represents the determined wall thickness progression 4 of the already measured pipe section. As already explained with reference to FIG. 2, the control unit 1B, taking into account the known distance a of the integrated device 10 of the pipe position measuring device and the wall thickness measuring device from the first roll stand 7-1, determines from the measured length coordinate of the pipe currently transmitted by the pipe position measuring device which pipe position or pipe coordinate, as the case may be, is currently entering the first roll stand, and which pipe section has already entered the roll stands 7. At the same time, the control unit 1B determines the current wall thickness at the pipe position currently entering the first roll stand 7-1 from the data stream of the wall thickness progression 4 and calculates any necessary rotational speed corrections on the basis of this data, so that the wall thickness variations of the pipe to be rolled are corrected during rolling.

The exemplary embodiment illustrated in FIG. 3 offers a particularly high precision with regard to the compensation of wall thickness variations of the pipe to be rolled, since the current wall thickness and the current longitudinal coordinate of the pipe are measured at a small distance from the first roll stand, while at the same time a front section of the pipe is rolled.

LIST OF REFERENCE SIGNS

1, 1A, 1B Control unit
2-1 Pipe position measuring device
2-2 Wall thickness measuring device
3 Evaluation unit
4 Determined wall thickness
5 Proximity sensor
6 Pipe
7 Roll stands
7-1 First roll stand
8 Pipe position measuring device
9 Wall thickness measuring device
10 Integrated measuring device
a Distance between proximity sensor or pipe position measuring device, as the case may be, and first roll stand
lges Total length of the pipe
lx Longitudinal coordinate
lx1 Pipe length already measured by pipe position measuring device
s Wall thickness of the pipe
t0 Point in time of pipe tip detection
t Current time
v Approach speed of the pipe

The invention claimed is:

1. A method, comprising:

providing a stretch reducing rolling mill having a plurality of roll stands (7) arranged one behind the other in a conveying direction of a pipe (6) to be rolled;

determining, by a wall thickness measuring device (2-2, 9), a wall thickness progression (4) of the pipe (6) to be rolled prior to rolling;

continuously measuring a current longitudinal coordinate (lx) of the pipe (6) by a pipe position measuring device (8) arranged in front of the plurality of roll stands (7) in the conveying direction;

transmitting the measured values of the longitudinal coordinate (lx) of the pipe (6) to a control unit (1A, 1B); and controlling, by the control unit (1A, 1B), respective rotational speeds of the plurality of roll stands (7) during the rolling of the pipe based on the determined wall thickness progression (4) and the transmitted measured values of the current longitudinal coordinate (lx) of the pipe, in order to compensate for wall thickness variations of the pipe.

2. The method according to claim 1, wherein the control unit (1A, 1B) controls a rolling of a first section of the pipe based on the measured values of the longitudinal coordinate (lx) of the pipe, while the pipe position measuring device (8) continuously measures the current longitudinal coordinate (lx) of the pipe at a second section of the pipe.

3. The method according to claim 1, wherein the control unit (1B) controls a rolling of a first section of the pipe while the wall thickness measuring device (9) determines a wall thickness progression (4) at a second section of the pipe.

4. The method according to claim 1, wherein the measured values of the longitudinal coordinate (lx) of the pipe measured by the pipe position measuring device (8) are used for determining the wall thickness progression (4) and for transmission to the control unit (1B).

5. The method according to claim 1, wherein the pipe position measuring device (8) measures the longitudinal coordinate (lx) of the pipe only after the wall thickness measuring device (2-2) has determined the wall thickness progression over a total length of the pipe (6) to be rolled.

6. The method according to claim 1, wherein the control unit (1A, 1B) controls rotational speeds of the plurality of roll stands (7) based also on signals from sensors arranged inside the stretch reducing rolling mill and/or behind the stretch reducing rolling mill in the conveying direction of the pipe, in order to compensate for wall thickness variations of the pipe during rolling.

7. A control unit (1A, 1B) for a stretch reducing rolling mill for rolling pipes, the stretch reducing rolling mill having a plurality of roll stands (7) arranged one behind the other in a conveying direction of a pipe (6) to be rolled, wherein the control unit (1A, 1B) is configured to control respective rotational speeds of the plurality of roll stands (7) based on a wall thickness progression (4) of the pipe to be rolled, the wall thickness progression (4) being determined by a wall thickness measuring device (2-2, 9) prior to rolling, wherein the control unit (1A, 1B) is configured to receive measured values of a current longitudinal coordinate (lx) of the pipe (6) measured continuously by a pipe position measuring device (8) arranged in front of the plurality of roll stands (7) in the conveying direction, and wherein the control unit (1A, 1B) is further configured to control the rotational speeds of the plurality of roll stands (7) during the rolling of the pipe also based on the received measured values of the current longitudinal coordinate (lx) of the pipe, in order to compensate for wall thickness variations of the pipe.

8. A stretch reducing rolling mill for rolling pipes, comprising:

a plurality of roll stands (7) arranged in series in a conveying direction of a pipe to be rolled;

a wall thickness measuring device (2-2, 9) arranged in front of the plurality of roll stands for determining a wall thickness progression (4) of the pipe (6) to be rolled;

a control unit (1, 1A, 1B) for controlling respective rotational speeds of the plurality of roll stands (7) during the rolling of the pipe; and a pipe position measuring device (8) arranged in front of the plurality of roll stands (7) in the conveying direction for continuously measuring a current longitudinal coordinate (lx) of the pipe and for transmitting the measured values of the current longitudinal coordinate (lx) of the pipe to the control unit (1A, 1B), wherein the control unit (1A, 1B) is configured to control the rotational speeds of the plurality of roll stands (7) during the rolling of the pipe based on the determined wall thickness progression (4) and the measured values of the current longitudinal coordinate (lx) of the pipe, in order to compensate for wall thickness variations of the pipe.

9. The stretch reducing rolling mill according to claim 8, wherein a conveying path of the pipe (6) to be rolled from the pipe position measuring device (8) to a first roll stand (7-1) of the plurality of roll stands (7) of the stretch reducing rolling mill in the conveying direction is shorter than a total length of the pipe (6) to be rolled.

10. The stretch reducing rolling mill according to claim 8, wherein a conveying path of the pipe (6) to be rolled from the pipe position measuring device (8) to a first roll stand (7-1) of the plurality of roll stands (7) of the stretch reducing rolling mill in the conveying direction is shorter than a half of a total length of the pipe (6) to be rolled.

11. The stretch reducing rolling mill according to claim 8, wherein a conveying path of the pipe (6) to be rolled from the pipe position measuring device (8) to a first roll stand (7-1) of the plurality of roll stands (7) of the stretch reducing rolling mill in the conveying direction is shorter than a quarter of a total length of the pipe (6) to be rolled.

12. The stretch reducing rolling mill according to claim 8, wherein a conveying path of the pipe (6) to be rolled from the wall thickness measuring device (9) to a first roll stand (7-1) of the plurality of roll stands (7) of the stretch reducing rolling mill in the conveying direction is shorter than a total length of the pipe (6) to be rolled.

13. The stretch reducing rolling mill according to claim 8, wherein a conveying path of the pipe (6) to be rolled from the wall thickness measuring device (9) to a first roll stand (7-1) of the plurality of roll stands (7) of the stretch reducing rolling mill in the conveying direction is shorter than a half of a total length of the pipe (6) to be rolled.

14. The stretch reducing rolling mill according to claim 8, wherein a conveying path of the pipe (6) to be rolled from the wall thickness measuring device (9) to a first roll stand (7-1) of the plurality of roll stands (7) of the stretch reducing rolling mill in the conveying direction is shorter than a quarter of a total length of the pipe (6) to be rolled.

15. The stretch reducing rolling mill according to claim 8, wherein the pipe position measuring device (8) and the wall thickness measuring device (9) are configured for simultaneous measurement of the pipe (6) to be rolled and are configured as an integrated device (10).

16. The stretch reducing rolling mill according to claim 8, wherein a conveying path of the pipe to be rolled between the wall thickness measuring device (2-2) and the pipe position measuring device (8) is longer than a total length of the pipe (6) to be rolled.

17. The stretch reducing rolling mill according to claim 8, wherein the stretch reducing rolling mill is coupled to or provided with sensors arranged inside the stretch reducing rolling mill and/or behind the stretch reducing rolling mill in the conveying direction of the pipe, and wherein the control unit (1A, 1B) is configured to control the rotational speeds of the plurality of roll stands (7) also based on signals from the sensors, in order to compensate for wall thickness variations of the pipe during rolling.

* * * * *